US009623432B2

(12) United States Patent
Schmidt

(10) Patent No.: US 9,623,432 B2
(45) Date of Patent: Apr. 18, 2017

(54) TREATMENT UNIT, INSTALLATION AND METHOD FOR THE SURFACE TREATMENT OF ARTICLES

(75) Inventor: Roger Schmidt, Dettenhausen (DE)

(73) Assignee: EISENMANN AG, Boeblingen (DE)

( * ) Notice: Subject to any disclaimer, the term of this patent is extended or adjusted under 35 U.S.C. 154(b) by 523 days.

(21) Appl. No.: 14/007,707

(22) PCT Filed: Apr. 5, 2012

(86) PCT No.: PCT/EP2012/001508

§ 371 (c)(1),
(2), (4) Date: Sep. 26, 2013

(87) PCT Pub. No.: WO2012/143093

PCT Pub. Date: Oct. 26, 2012

(65) Prior Publication Data

US 2014/0030439 A1 Jan. 30, 2014

(30) Foreign Application Priority Data

Apr. 16, 2011 (DE) ..... 10 2011 017 347

(51) Int. Cl.
*B05B 15/12* (2006.01)
*B05B 13/02* (2006.01)
*B05B 13/04* (2006.01)

(52) U.S. Cl.
CPC ..... *B05B 15/1288* (2013.01); *B05B 13/0221* (2013.01); *B05B 13/0431* (2013.01); *B05B 13/0447* (2013.01)

(58) Field of Classification Search
None
See application file for complete search history.

(56) References Cited

U.S. PATENT DOCUMENTS 4,930,213 A 6/1990 Hayakawa et al.
5,079,822 A 1/1992 Arai et al.
(Continued)

FOREIGN PATENT DOCUMENTS

DE 199 45 291 A1 5/2001
EP 0 108 289 5/1984
(Continued)

*Primary Examiner* — Nathan T Leong
(74) *Attorney, Agent, or Firm* — Factor Intellectual Property Law Group, Ltd.

(57) ABSTRACT

A treatment unit for the surface treatment of articles having at least one treatment chamber and a conveying system which conveys articles to be treated into the treatment chamber, along a conveying path through the treatment chamber and back out of the treatment chamber. Each article in each position on the conveying path prescribes a conveying direction tangential to the conveying path. An application system includes at least one multiaxis application robot, which takes along with it an application device and moves along a robot path of movement. The conveying system and the application system are set up such that the at least one application robot moves in relation to the conveying direction of an article optionally with a movement component parallel to the conveying direction of the article and/or a movement component perpendicular to the conveying direction of the article. Also, an installation and a method for the surface treatment of articles.

6 Claims, 4 Drawing Sheets

(56) References Cited

U.S. PATENT DOCUMENTS

| | | | | |
|---|---|---|---|---|
| 6,350,491 | B1 | 2/2002 | Williams | |
| 7,677,196 | B2 * | 3/2010 | Herre | B05B 12/122 118/309 |
| 7,798,094 | B2 | 9/2010 | Meissner | |
| 8,545,943 | B2 | 10/2013 | Frankenberger et al. | |
| 2006/0198952 | A1 * | 9/2006 | Nagase | B05C 1/0813 427/154 |
| 2011/0166708 | A1 | 7/2011 | Herre et al. | |

FOREIGN PATENT DOCUMENTS

| | | |
|---|---|---|
| GB | 2 190 312 | 11/1987 |
| GB | 2 263 422 | 7/1993 |
| WO | 2004/087335 | 10/2004 |

* cited by examiner

TREATMENT UNIT, INSTALLATION AND METHOD FOR THE SURFACE TREATMENT OF ARTICLES

RELATED APPLICATIONS

This application is a national phase of International Application No. PCT/EP2012/001508 filed on Apr. 5, 2012, which claims the filing benefit of German Patent Application No. 10 2011 017 347.1 filed on Apr. 16, 2011, the contents of both of which are herein incorporated by reference.

FIELD OF THE INVENTION

The invention relates to a treatment unit for the surface treatment of articles, having a) at least one treatment chamber;

b) a conveying system by means of which articles to be treated may be conveyed into the treatment chamber, through the treatment chamber along a conveying path, and out of the treatment chamber again, wherein in any position on the conveying path each article determines a direction of conveying that is tangential to the conveying path;

c) an application system which comprises at least one multiple-axis application robot which carries with it an application means and may travel along a robot movement path.

The invention moreover relates to an installation for the surface treatment of articles and to a method for the surface treatment of articles in a treatment chamber, in which a) the articles are conveyed into the treatment chamber, through the treatment chamber along a conveying path, and out of the treatment chamber again, during which in any position on the conveying path they determine a direction of conveying that is tangential to the conveying path;

b) at least one multiple-axis application robot which carries with it an application means travels along a robot movement path.

The surface treatment in particular takes the form of painting, wherein in particular vehicle body parts are treated or painted.

In painting installations known from the market, the vehicle body parts are conveyed, on workpiece holders, through the treatment chamber of a treatment installation of the type mentioned at the outset and are coated with a paint by means of one or more multiple-axis application robots, as are known per se. The vehicle body parts may in this case be conveyed through the treatment chamber continuously or intermittently; this is also the case in the present invention.

Some vehicle body parts may be treated or painted effectively in different orientations in space, that is to say in different application positions, as a result of which there are on the market installations of different constructions for particular vehicle body parts, and these are adapted to one or another application position of the articles to be treated.

For example when painting bumpers, two alternative application positions for the bumpers on workpiece holders have become established, leading to different painting procedures. On the one hand, the bumpers may be secured to the workpiece holder in a so-called installation position. In this installation position, they are oriented approximately in the manner of a bumper mounted on a vehicle, such that the front face of the bumpers points largely in a horizontal direction perpendicular to the direction of conveying. Bumpers in the installation position are arranged on the workpiece holder one above the other in the vertical direction and typically such that their longitudinal extent runs parallel to the direction of conveying between their two opposing end faces. On the other hand, the bumpers may be secured to the workpiece holder in a so-called sleeper position, in which their front face is oriented upwards. In this case, the bumpers are typically also turned through 90° about a vertical axis by comparison with the installation position, and extend perpendicular to the direction of conveying. Bumpers in the sleeper position are typically arranged on the workpiece holder one behind the other in a horizontal plane.

When bumpers that are conveyed through the treatment chamber in the installation position are to be treated, treatment must be performed from the side. In this case, the application robot travels parallel to the direction of conveying the bumpers. During painting, for this purpose the application means guided by the application robot—such as a spray gun or a rotary atomiser—is moved laterally next to the workpiece holder. For bumpers in the sleeper position, by contrast, treatment must be performed from above, for which purpose the application means is accordingly guided by the application robot above the bumpers.

Frequently, installations known on the market can only paint bumpers in one of the two application positions.

However, it may happen that, during treatment phases before painting, bumpers, or articles to be treated in general, have to adopt a position on a workpiece holder which does not correspond to the application position required for the treatment unit. In this case, before painting, the bumpers or other articles have to be transferred to another workpiece holder and so put into the required application position. This takes time and correspondingly reduces the possible total throughput of the installation.

It is therefore an object of the invention to provide a treatment unit, an installation and a method of the type mentioned at the outset which give greater flexibility in respect of the application position of the articles to be treated in which the latter are conveyed through the treatment chamber.

SUMMARY OF THE INVENTION

This object may be achieved in a treatment unit of the type mentioned at the outset in that d) the conveying system and the application system are set up such that the at least one application robot may travel in relation to the direction of conveying an article, selectively with da) a movement component parallel to the direction of conveying the article and/or db) a movement component perpendicular to the direction of conveying the article.

In known installations, the articles travel in an invariable direction of conveying, and the application robot or robots travel on an invariable rectilinear movement path, either only in parallel directions or only in mutually perpendicular directions. To take as an example the bumpers in question, these may thus be treated in an appropriate treatment unit either only in the installation position or only in the sleeper position.

According to the invention, by contrast, the relative movement between the application robot and the articles to be treated may now be changed and, in the case of bumpers for example, be determined as a function of the application position in which these are conveyed through the treatment chamber. Relative movement means that either the article or articles can travel in relation to the stationary application robot or the application robot can travel in relation to the article or articles.

If for example bumpers arrive in the treatment chamber in the installation position, the application robot travels parallel to the direction of conveying the bumpers. However, the application robot can selectively travel perpendicular to the direction of conveying the bumpers if the bumpers are conveyed through the treatment chamber in the sleeper position. This applies accordingly for articles other than bumpers.

It is particularly favourable if the at least one application robot is borne such that it may travel on a guide rail which determines the path of movement of the robot and is arranged at a height above the articles to be treated that are being conveyed through the treatment chamber. In that case, the articles may move along below the application robot, as a result of which the path of movement of the application robot and the conveying path of the articles can intersect without any risk of collision. To put this in general terms, the application robot is to be guided such that the articles are accessible to it both from above and from the side for the purpose of painting. This is also possible if the application robot is guided in another way.

It is favourable if the conveying system comprises a conveying rail system on which workpiece holders holding the articles to be treated may travel.

If the conveying rail system comprises a set of points by means of which sections of the conveying rail system that run in the same direction or at an angle to one another may be connected to one another, such that different conveying paths for the articles may be determined selectively, the direction of conveying the articles may also selectively be changed while they are being conveyed through the treatment chamber. In this case, the articles may also be arranged in different orientations on a single workpiece holder. For example, after bumpers have been painted in the installation position, the direction of conveying may be changed in relation to the application robot and bumpers may be painted in the sleeper position.

Here, it is advantageous if the robot movement path runs rectilinearly, since in this case there is no need for complex line guidance for supply and power lines to the application robot.

However, it may be favourable if the robot movement path has a curved course, at least in certain regions. In this case a single rectilinear conveying path that is provided may be sufficient for the articles, since the desired and necessary change in the relative movement between the articles and the application robot may be achieved by a curved movement of the application robot. Preferably, in this case the robot movement path comprises two rectilinear section that are connected by a curved region and are at an angle of 90° to one another.

It is advantageous if the treatment chamber has at least one entry and at least one exit which are connected to one another by way of a conveying path.

In particular, variants in which the treatment chamber has an entry or a first entry and a second entry are advantageous, wherein each entry present is connected to an exit or a first exit and a second exit by way of a conveying path.

Thus, a single entry may be connected to a single exit or to a first and a second exit. Alternatively, a first entry and a second entry may be connected to a single exit. Moreover, a first entry may be connected to a first exit and a second entry to a second exit. Further, a first entry may be connected to a first exit and a second entry be connected to the first exit and a second exit. In addition, a first and a second entry may be connected respectively to a first and a second exit.

The various entries and exits present provide space for a correspondingly constructed conveying rail system which makes possible an extremely varied range of conveying paths between the entries and exits present, wherein it is possible to move the articles on these conveying paths in relation to the application robot such that the desired relative movements are possible.

As regards the installation of the type mentioned at the outset, the object mentioned above may be achieved in that at least one treatment unit having some or all of the features explained above is provided.

As regards the method of the type mentioned at the outset, the object mentioned above may be achieved in that c) the at least one application robot travels in relation to the direction of conveying an article, selectively with
   ca) a movement component parallel to the direction of conveying the article
   and/or
   cb) a movement component perpendicular to the direction of conveying the article.

The advantages thereof and those of the measures explained below correspond accordingly to the corresponding features of the treatment unit according to the invention.

Consequently, it is favourable if the at least one application robot travels on a guide rail which determines the path of movement of the robot and is arranged at a height above the articles to be treated that are being conveyed through the treatment chamber. To put this in general terms, the application robot is guided such that the articles are accessible to it both from above and from the side for the purpose of painting. This is also possible with another type of guiding.

Secure guidance of the articles through the treatment chamber is possible if workpiece holders which hold the articles to be treated travel on a conveying rail system.

The desired flexibility is achieved in particular if different conveying paths for the articles can be determined.

In this case, the at least one application robot may travel on a rectilinear robot movement path.

Alternatively or where appropriate in addition, with a further application robot it is advantageous if the at least one application robot travels on a robot movement path which is curved, at least in certain regions.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in more detail below with reference to the drawings, in which.

DETAILED DESCRIPTION OF THE PRESENT INVENTION

Figure 2:
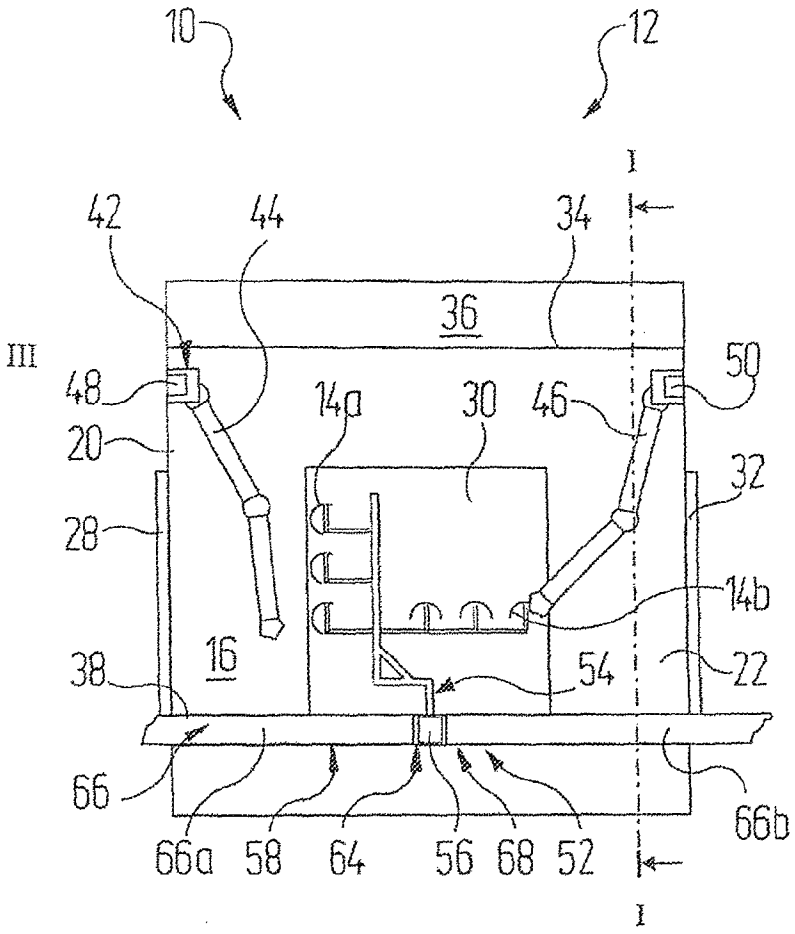
FIG. 2 shows a vertical section through the paint booth in FIG. 1, along the line of section II-II there.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIGS. 1 to 4, a treatment booth constructed as a paint booth, according to a first exemplary embodiment, is designated 10 as a whole. The paint booth 10 is shown in a treatment installation 12 for the surface treatment of articles 14 which, in the present exemplary embodiment, by way of example are illustrated as vehicle body parts in the form of bumpers for motor vehicles, which are designated 14*a* and 14*b*. This will be explained further below.

In the treatment installation, articles other than vehicle body parts may also be treated, for example also articles which are as varied as white goods, golf balls, radio panels, vehicle wheels or similar.

The paint booth 10 defines a treatment chamber 16 which is delimited by four vertical side walls 18, 20, 22 and 24. In the side walls 18 and 20 there is provided respectively a first and a second entry 26, 28 and in the side walls 22 and 24 there is provided respectively a first and a second exit 30, 32, by way of which the bumpers 14 to be treated can respectively be conveyed into the treatment chamber 16 from the outside and out of it again.

At the top the paint booth 10 has a horizontal booth ceiling 34 which takes the form of a lower delimitation of an air supply chamber 36. Air is introduced into the treatment chamber 16 by way of the air supply chamber 36 and then flows downwards through the treatment chamber 16.

The treatment chamber 16 is downwardly open by way of a floor 38 which takes the form of a grating and leads to a flow region 40, from which the air coming from the treatment chamber 16 can be supplied to a cleaning procedure and a further conditioning procedure, as is known per se.

In order to paint the bumpers 14 in the booth chamber 16, an application system 42 is provided. This comprises a first and a second multiple-axis—in the present exemplary embodiment in total seven-axis—application robot 44 and 46 respectively that are arranged in the booth chamber 16. The two application robots 44, 46 each carry with them an application means which is not provided with its own reference numeral and is for example in the form of a spray gun or a rotary atomiser.

The first application robot 44 is provided on the booth wall 20 and can travel along a rectilinear horizontal guide rail 48 extending above the entry 28 in the booth wall 20. In this way, one of the movement axes of the application robot 44 is its travel axis. In corresponding manner, the second application robot 46 is provided on the booth wall 24 opposite and can travel along a rectilinear horizontal guide rail 50 extending above the aperture 32 in the booth wall 24. In this way, in the case of the second application robot 46 too, one of the movement axes is its travel axis. The guide rails 48 and 50 are overall arranged at a height above the bumpers 14 to be treated that are being conveyed through the treatment chamber 16.

The bumpers 14 to be treated are conveyed through the treatment booth 10 by means of a conveying system 52. To this end, a plurality of bumpers 14 are secured to a workpiece holder 54 which, for its part, is carried along by a carriage 56, which can be seen only in FIG. 2. The carriage 56 can travel in a conveying rail system 58 which is arranged below the floor 38 in the flow region 40 of the paint booth 10. The conveying rail system 58 and the floor 38 of the paint booth 10 are constructed such that the workpiece holder 54 projects upwards through the floor 38 and into the booth chamber 16. The carriage 56 may for example be driven by means of an endless drive means such as a chain; this is known per se.

Figure 1:
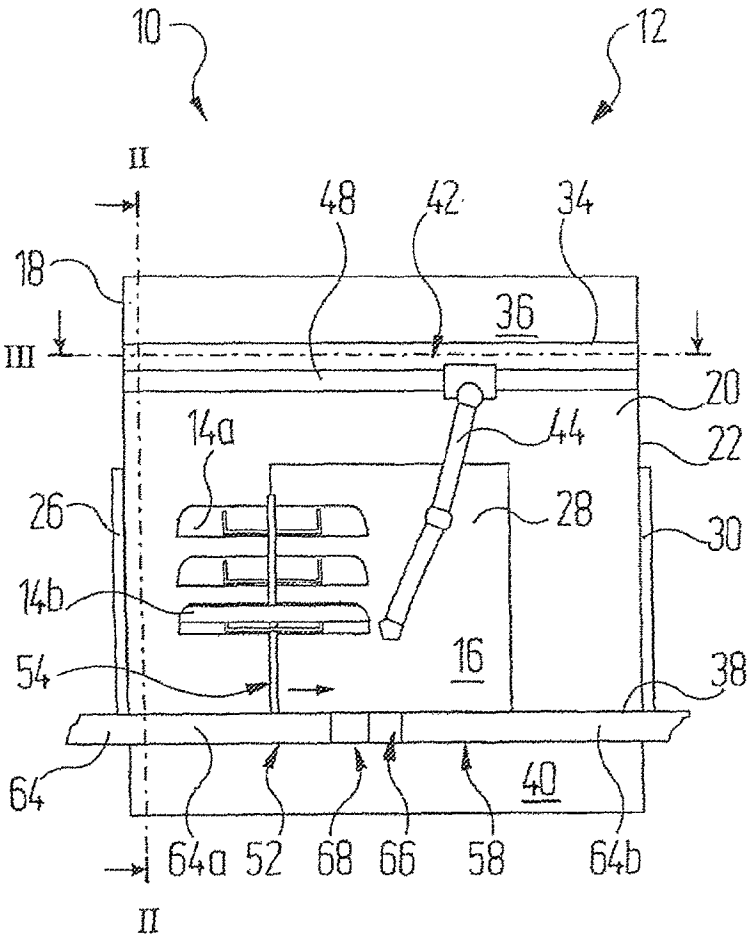
FIG. 1 shows a vertical section through a paint booth according to a first exemplary embodiment, along the line of section I-I in FIG. 2, wherein application robots and a conveying system are shown.

In order to illustrate the application positions of the bumpers 14 that were mentioned at the outset, the workpiece holder 54 is shown in FIGS. 1 and 2 with bumpers 14 in two different application positions. On the one hand, bumpers 14*a* are secured to the workpiece holder 54 in the installation position mentioned at the outset, one above the other in the vertical direction. On the other hand, bumpers 14*b* are secured to the workpiece holder 54 in the sleeper position also mentioned above, one behind the other in a horizontal plane.

In practice, however, usually either only bumpers 14*a* in the installation position or only bumpers 14*b* in the sleeper position are mounted on the workpiece holder 54.

As mentioned at the outset, bumpers 14*a* in the installation position have to be coated with paint from the side, whereas this has to take place from above with bumpers 14*b* in the sleeper position. The application robots 44 and 46 are set up such that they can coat bumpers 14 from above or from the side selectively, with the result that each application robot 44, 46 can coat both bumpers 14*a* in the installation position and bumpers 14*b* in the sleeper position.

In each case, a certain working volume in the booth chamber 16 is accessible for the application robots 44 and 46. To illustrate this, the booth chamber 16 in FIGS. 3 to 8 is in each case divided into four chamber quadrants A, B, C and D which should be understood as three-dimensional space.

In the variants shown in FIGS. 1 to 6 and 8, in each case chamber quadrants A and B are accessible to the first application robot 44 and in each case chamber quadrants C and D are accessible to the second application robot 46. In the exemplary embodiment according to FIG. 7, the first application robot 44 can also cover chamber quadrant C and the second application robot 46 can also cover chamber quadrant B. This will be further discussed below.

This allocation of the chamber quadrants A, B, C and D does not mean that a particular application robot 44 or 46 has in fact to be able to reach every point in the chamber quadrants A, B, C or D allocated to it so that the paint booth 10 can be operated properly. Here, the relevant point is merely that the application robot 44 or 46 can reach the respective bumpers 14 which are to be coated by it and which are entirely or partly in a particular chamber quadrant A to D.

Figure 4:
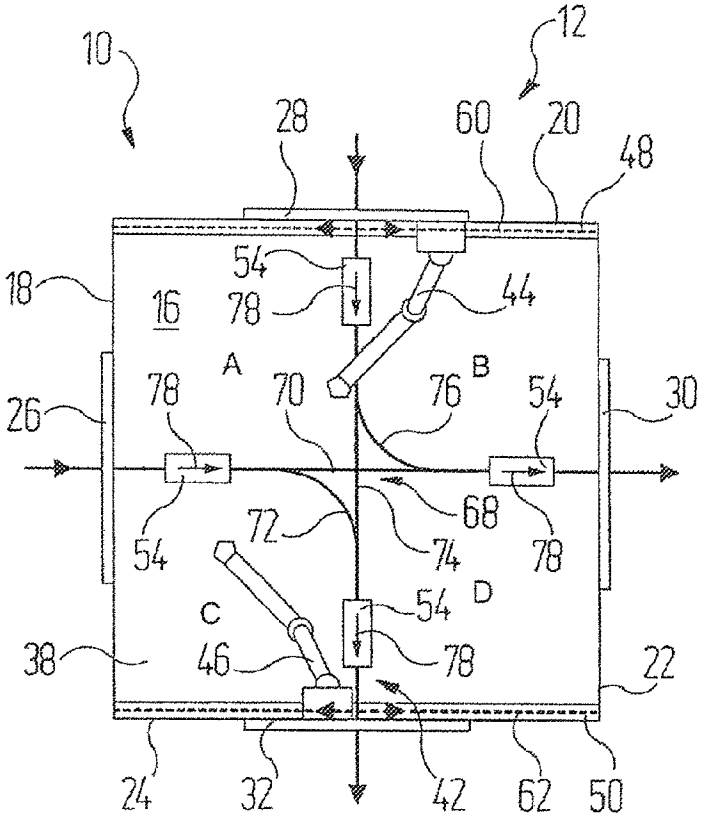
FIG. 4 shows the horizontal section from FIG. 3, in which possible conveying paths of the conveying system along which articles to be treated may be conveyed and movement paths of the application robots are illustrated.
Figure 3:
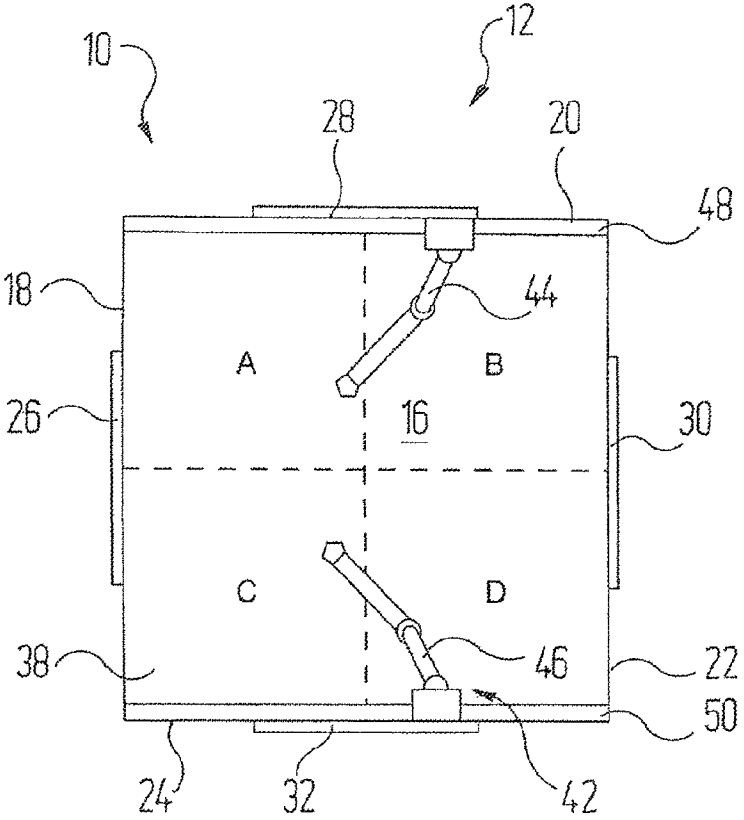
FIG. 3 shows a horizontal section through the paint booth in FIG. 1, along the line of section III-III there, wherein the conveying system is not illustrated.

In FIG. 4, the movement paths of the first and the second application robot 44 or 46 along the associated guide rail 48 and 50 respectively are each shown as a bold dashed line and designated 60 and 62 respectively.

In the first exemplary embodiment, shown in FIGS. 1 to 4, the conveying rail system 58 for the bumpers 14 to be treated comprises a first rectilinear rail line 64 which leads from the first entry 26 in the side wall 18 to the first exit 30 in the side wall 22. The first rail line 64 is intersected by a second rectilinear rail line 66 which leads from the second entry 28 in the side wall 20 to the second exit 32 in the side wall 24.

As a result of the intersection, the rail lines 64, 66 are each divided into two sections 64*a*, 64*b* and 66*a*, 66*b*. Moreover, a points unit 68 is provided which can be put into different points positions, in which the rail line section 64*a* is either connected to the rail line section 64*b* or the rail line section 66*b*, and the rail line section 66*a* is either connected to the rail line section 66*b* or the rail line section 64*b*.

In this way, the points unit 68 can connect to one another the different sections 64*a*, 64*b*, 66*a*, 66*b* of the conveying rail system 58, which run in the same direction or at an angle to one another.

The bumpers 14 are conveyed on the workpiece holder 54 either through the first entry 26 or the second entry 28 and into the treatment chamber 16.

FIG. 4 shows, in bold continuous lines, the possible conveying paths on which the bumpers 14 can be conveyed through the treatment booth 16 of the paint booth 10. A first conveying path 70 leads from the first entry 26 to the first exit 30 opposite. A second conveying path 72 leads from the first entry 26 to the second exit 32. A third conveying path 74 leads from the second entry 28 to the second exit 32 opposite, and a fourth conveying path 76 leads from the second entry 28 to the first exit 30.

To put this in general terms, a particular conveying path thus always leads between an entry and an exit, and a workpiece holder 54 or the bumpers 14 are always conveyed through the treatment chamber 16 from an entry to an exit.

The conveying path 70, 72, 74 or 76 along which the bumpers 14 can be conveyed through the treatment chamber 16 thus depends on which of the two entries 26 or 28 the bumpers 14 on the workpiece holder 54 are brought through into the treatment chamber 16, and which points position the points unit 68 adopts.

In a modification, the points unit 68 may also be constructed such that only the conveying paths 70 and 72 and 74 or only the conveying paths 70 and 74 and 76 are possible.

On the way through the treatment chamber 16, the workpiece holder 54 or each bumper 14 in each position on the respective conveying path 70, 72, 74 or 76 determines a direction of conveying which is tangential to the conveying path 70, 72, 74 or 76 at the location at that moment of the workpiece holder 54 or the bumper 14 in question. This is illustrated by FIG. 4, which shows schematically illustrated workpiece holders 54 in different positions on the conveying paths 70, 72, 74 or 76 by means of arrows, which are each designated 78 and indicate the direction of conveying for bumpers 14 or the respective workpiece holder 54. Thus, for example, if the workpiece holder 54 is at that moment in one of the curved sections of the points unit 68 that are indicated in FIG. 4, the direction of conveying 78 is at an angle to the rectilinear conveying path 70 and to the rectilinear conveying path 74.

In this way, the application system 42 and the conveying system 52 are matched to one another and set up such that the application robots 44, 46 can travel, in relation to the direction 78 of conveying a bumper 14, selectively with a movement component parallel to the direction 78 of conveying a bumper 14 and/or with a movement component perpendicular to the direction 78 of conveying a bumper 14.

This makes it possible for the bumpers 14*a*, 14*b* which are mounted on the workpiece holder 54 in mutually different positions to be painted in one and the same paint booth 10.

If only bumpers 14*a* in the installation position are mounted on the workpiece holder 54, they are conveyed on the first conveying path 70 from the first entry 26 to the first exit 30 opposite, wherein their longitudinal direction extends parallel to the direction of conveying 78, as is the case with the bumpers 14*a* in accordance with FIGS. 1 and 2.

In that case, the movement paths 60, 62 of both the first and the second application robot 44, 46 always extend parallel to the direction 78 of conveying the bumpers 14*a*. The application robots 44, 46 then, accordingly, always move parallel to this direction of conveying 78 and can paint the bumpers 14*a*, from the side, respectively in chamber quadrants A and B, and C and D.

In contrast, if only bumpers 14*b* in the sleeper position are mounted on the workpiece holder 54, they are conveyed on the third conveying path 74 from the second entry 28 to the second exit 32 opposite, although their longitudinal direction extends perpendicular to the direction of conveying 78. In this case, the movement paths 60, 62 of both the first and the second application robot 44, 46 always extend perpendicular to the direction 78 of conveying the bumpers 14. The application robots 44, 46 then, accordingly, always move perpendicular to this direction of conveying 78 and can paint the bumpers 14*b* from above.

In order to paint bumpers 14*a* and 14*b* that are in the installation position and in the sleeper position on the workpiece holder 54, as shown in FIGS. 1 and 2, the workpiece holder is for example also conveyed through the treatment chamber 16 on the first conveying path 70 from the first entry 26 to the first exit 30. In this case, the longitudinal direction of both the bumpers 14*a* in the installation position and the bumpers 14*b* in the sleeper position extends parallel to the direction of conveying 78.

The workpiece holder 54 is conveyed through the entry 26 into the treatment chamber 16 and is first located in the section 64*a* of the rail line 64. The bumpers 14*a* in the installation position are then located in chamber quadrant A and are accessible to the first application robot 44, and by means of the latter are painted from the side. The bumpers 14*b* in the sleeper position are located in chamber quadrant C, by contrast, and are accessible to the second application robot 46, and by means of the latter are painted from above.

During painting, the workpiece holder 54 can be conveyed through the treatment chamber 16 and can move on the conveying path 70 to the first exit 30.

If the workpiece holder 54 is to leave the treatment chamber 16 by way of its second exit 32, the points unit 68 is set such that the rail line section 64*a* of the rail line 64 is connected to the section 66*b* of the rail line 66.

The workpiece holder 54 passes out of the rail line section 64*a* and into the points unit 68, arriving at the section 66*b* of the rail line 66 and by way of this at the exit 32. The painting procedure in chamber quadrants A and C should be complete before the points unit 68 has been reached.

In a modification, the conveying system 52 is set up such that the bumpers 14, or in general the articles to be treated, retain their orientation in the treatment chamber 16, or to put it another way they change their orientation in relation to the direction of conveying 78 if the direction of conveying 78 on the selected conveying path changes.

When the workpiece holder 54 then leaves the rail line section 64*a* to enter the rail line section 66*b* to the exit 32, this orientation of the bumpers 14 is then maintained such that the bumpers 14 are arranged in the rail line section 66*b* perpendicular to the direction of conveying 78. The same may apply to the other conveying paths on which the direction of conveying 78 changes.

If the bumpers 14*a* and 14*b* are mounted on the workpiece holder 54 the other way around to that shown in FIGS. 1 and 2, that is if the bumpers 14*b* in the sleeper position are located in the place of the bumpers 14*a* in the installation position and vice versa, the workpiece holder 54 may be conveyed for example along the third conveying path 74 from the second entry 28 to the second exit 32. In this case, the longitudinal direction of both the bumpers 14*a* in the installation position and the bumpers 14*b* in the sleeper position extends perpendicular to the direction of conveying 78. The bumpers 14*b* in the sleeper position are in that case painted in the region of chamber quadrants A and B corresponding to the rail line section 66*a*, by means of the first application robot 44, which in so doing can move perpendicular to the direction 78 of conveying the bumpers 14.

When the workpiece holder 54 is then located in the rail line section 66*b*, the bumpers 14*a* in the installation position are painted in the corresponding region of chamber quadrants C and D by means of the second application robot 46, which in so doing can also move perpendicular to the direction 78 of conveying the bumpers 14.

In the modification in which the workpiece holder 54 can turn in the points region, the fourth conveying path 76 could also be envisaged as the conveying path. In this case the second application robot 46 could paint the bumpers 14*a* in the installation position from the side when the workpiece holder 54 is located in the rail line section 64*a* of the rail line 64.

In FIGS. 5 to 8, as further exemplary embodiments there are shown paint booths 80, 82, 84 and 86 respectively in which the conveying system 52 and the application system 42 are set up such that the application robots 44, 46 can travel in relation to the direction 78 of conveying the bumpers 14 selectively with a movement component parallel to the direction 78 of conveying a bumper 14 and/or a movement component perpendicular to the direction 78 of conveying a bumper 14.

In the case of the paint booths 80, 82, 84 and 86, components that correspond to the components of the paint booth 10 in accordance with FIGS. 1 to 4 are provided with the same reference numerals. The statements made above in respect of the paint booth 10 apply accordingly to the paint booths 80, 82, 84 and 86 in the absence of an explanation to the contrary.

Figure 5:
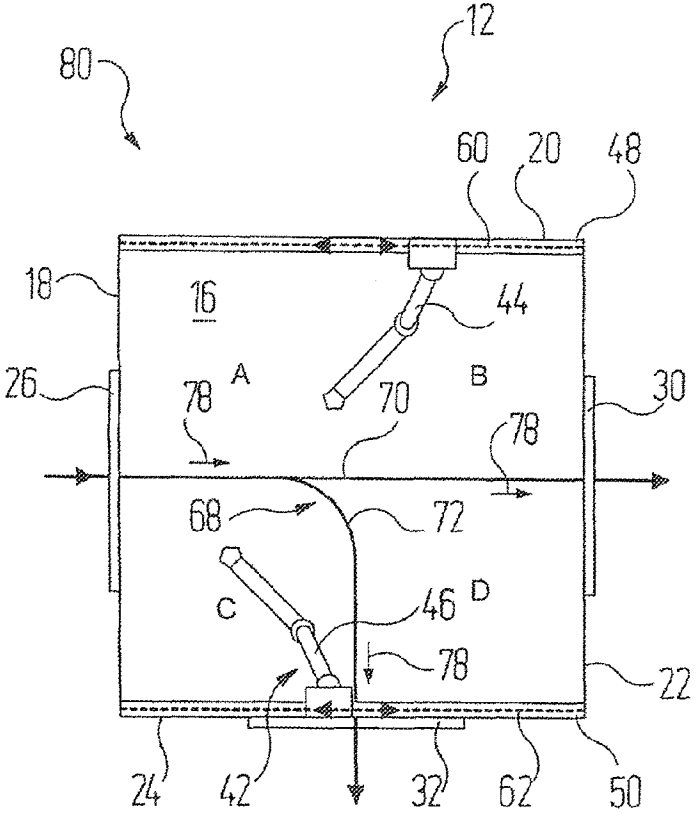

In the paint booth 80 according to FIG. 5, unlike the case of the paint booth 10, there is no second entry 28 and no rail line section 66*a*. The rail line 66 here comprises only the rail line section 66*b*, which extends from the points unit 68 to the second exit 32. By means of the points unit 68, the rail line sections 64*a* and 64*b* or 64*a* and 66*b* may be connected, as a result of which the workpiece holder 54 may selectively be conveyed through the treatment chamber 16 only along the conveying path 70 between the single entry 26 present and the first exit 30, or along the conveying path 72 between the entry 26 and the second exit 32.

Figure 6:
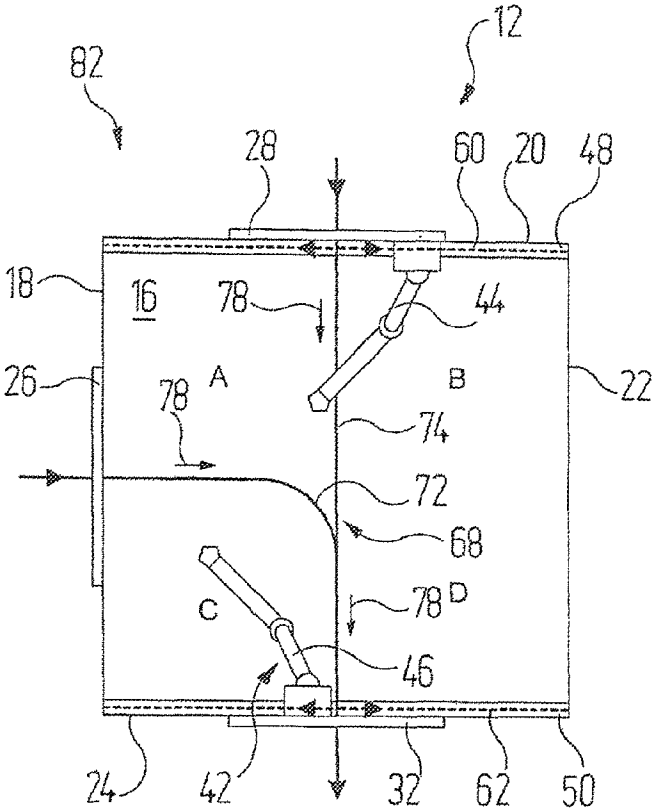
FIGS. 5 to 8 show further exemplary embodiments of the treatment booth with modified conveying and/or movement paths.

In the paint booth 82 according to FIG. 6, by contrast, unlike the case of the paint booth 10, there is no second exit 32 and no rail line section 64*b*. The rail line 64 here comprises only the rail line section 64*a*, which extends from the first entry 26 to the points unit 68. By means of the points unit 68, the rail line sections 64*a* and 66*b* or 66*a* and 66*b* may be connected selectively, as a result of which the workpiece holder 54 may selectively be conveyed through the treatment chamber 16 only along the conveying path 72 between the first entry 26 and the single exit 32 present, or along the conveying path 74 between the second entry 28 and the exit 32.

Figure 7:
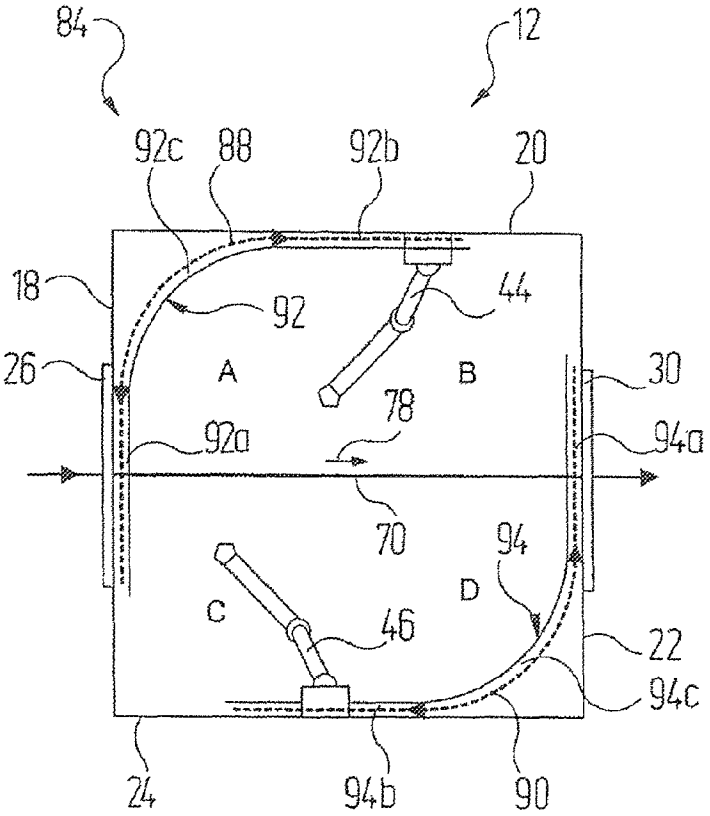

In the paint booth 84 according to FIG. 7, only the entry 26 and the exit 30 opposite this are present, and the rail line 64 extends between them without a set of points. Thus, the only conveying path through the treatment chamber 16 for the bumpers 14 is the conveying path 70 between the entry 26 and the exit 30. However, the application robots 44 and 46 can travel on movement paths 88 and 90 respectively which are curved in certain regions. To this end, a horizontal guide rail 92 which is curved in certain regions and extends above the entry 26 in the booth wall 18 is allocated to the first application robot 44.

The guide rail 92 for the first application robot 44 comprises a first rectilinear section 92*a* on the first side wall 18, that having the entry 26, of the paint booth 10, a second rectilinear section 92*b* on the second side wall 20 of the paint booth 10, and a section 92*c* which connects the two rectilinear sections 92*a*, 92*b* and is correspondingly curved. Correspondingly, a guide rail 94 which is curved in certain regions, for the second application robot 46, comprises a first rectilinear section 94*a* on the third side wall 22, that having the exit 30, of the paint booth 10, a second rectilinear section 94*b* on the fourth side wall 24 of the paint booth 10, and a section 94*c* which connects the two rectilinear sections 94*a*, 94*b* and is correspondingly curved.

Thus, the application robots 44, 46 can each be moved perpendicular to the direction 78 of conveying the bumpers 14 when they are located on their rail sections 92*a* and 94*a* of the guide rails 92 and 94 respectively. Correspondingly, by contrast, the application robots 44, 46 may each be moved parallel to the direction 78 of conveying the bumpers 14 when they are located on their rail sections 92*b* and 94*b* respectively. In the case of the paint booth 82, no account need be taken, in respect of the bumpers 14*a* in the installation position or the bumpers 14*b* in the sleeper position, of how their longitudinal direction is oriented in relation to the direction of conveying 78.

Figure 8:
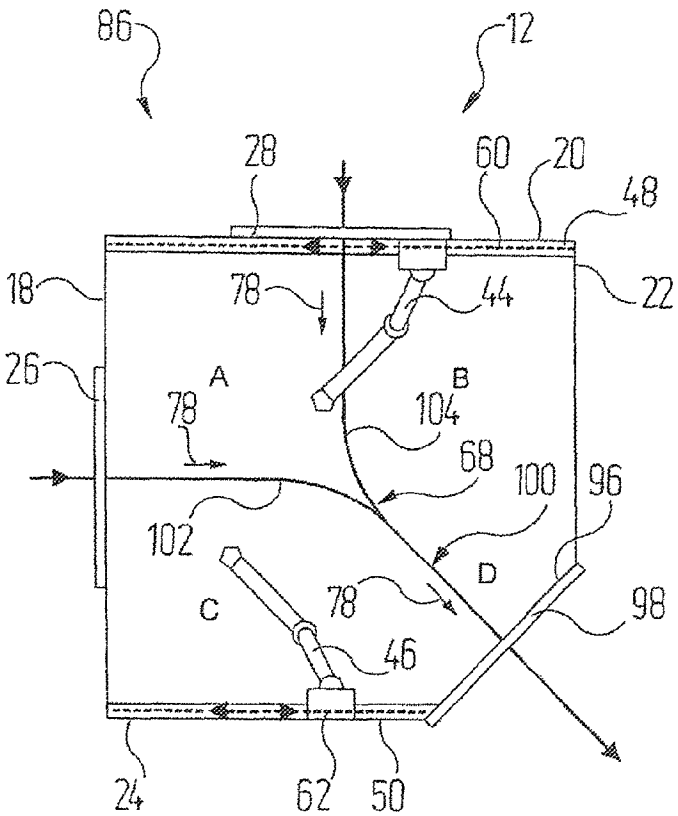

In the case of the paint booth 86 according to FIG. 8, although a first and a second entry 26 and 28 are again provided in the side walls 18 and 20, there are no exits 30 and 32 in the side walls 22 and 24 of the paint booth 86. Instead, an exit wall 96 which connects the third and the fourth side walls 22 and 24 to one another at an angle of 45° and has an exit 98 is provided.

Of the rail lines 64 and 66, in each case the rail line sections 64*a* and 66*a* are provided, and these may be connected selectively by way of a modified points unit 68 to a rail line 100 which extends from the points unit 68 in chamber quadrant D to the exit 98 and forms an angle of 135° in each case with the rail line sections 64*a* and 66*a*.

Thus, there are two conveying paths 102 and 104 on which the bumpers 14 may be conveyed through the treatment booth 16 of the paint booth 86. The conveying path 102 leads from the first entry 26 to the exit 98, and the conveying path 104 leads from the second entry 28 to the exit 98.

When the workpiece holder 54 is located in the rail line section 64*a* of the paint booth 86, both application robots 44, 46 can be moved parallel to the direction 78 of conveying the bumpers 14 and may paint bumpers 14 that are positioned in chamber quadrants A and C and are oriented parallel to the direction of conveying 78. By contrast, when the workpiece holder 54 is located in the rail line section 66*a* of the paint booth 86, the first application robot 44 can be moved perpendicular to the direction 78 of conveying the bumpers 14. This is of relevance to bumpers 14 that are secured to the workpiece holder 54 perpendicular to the direction of conveying 78. Once again these can then be painted by the first application robot 44 in the respective region of chamber quadrants A and B of the paint booth 86, into which the bumpers 14 project.

When the workpiece holder is located in the region of the rail line 100, the bumpers 14 are accessible to the second application robot 46 in chamber quadrant D of the paint booth 86, and can be painted there.

In all the exemplary embodiments explained above in the form of paint booths 10, 80, 82, 84 and 86, in each case the questions of through which of the entries 26, 28 present the bumpers 14 enter the treatment chamber 16, along which of the possible conveying paths 70, 72, 74, 76, 102 and 104 the bumpers 14 are conveyed through the treatment chamber 16, and through which of the exits 30, 32, 98 present the bumpers 14 are conveyed out of the treatment chamber 16 again depend on the articles mounted on the workpiece holder 54 and the course of the longitudinal direction of the bumpers 14 in relation to the direction of conveying 78.

As is clear from the description above, the bumpers 14 on the workpiece holder 54 both in the installation position and in the sleeper position may be arranged either parallel or perpendicular to the direction of conveying 78. Depending on whether the bumpers 14 are arranged on the workpiece holder 54 in an installation position or a sleeper position, and depending on whether the bumpers 14 are arranged parallel or perpendicular to the direction of conveying 78, the application robots 44 and 46 must be able to move parallel or perpendicular to the respective direction 78 of conveying the bumpers 14. This is achieved by an appropriate allocation of the entry and the exit and the conveying path lying between them and, where appropriate, by the addition of a points unit 68 that causes the workpiece holder 54 to turn, as described above.

In a further modification, it is also possible for only a single application robot to be arranged in each case in the treatment chamber 16 of the paint booths 10, 80, 82, 84 or 86. In this case, the workpiece holder 54 is preferably constructed such that it holds bumpers 14 in the installation position only on the side facing the application robot when the workpiece holder 54 and the application robot are moved parallel to one another.

Instead of the points unit 68, it is also possible to provide in each case a turntable or similar, such that the workpiece holder 54 can transfer from one rail line section to another in a similar manner. Where appropriate, it is also possible to dispense with the points unit 68. In the case of the paint booth 10, for example, the first entry 26 is then connected by way of the conveying path 70 to the first exit 30, and the second entry 28 is connected by way of the conveying path 74 to the second exit 32 without the possibility of a change in direction of the bumpers 14 while they are being conveyed through the treatment chamber 16. In this case, the bumpers 14 must be conveyed into the treatment chamber 16 by way of a particular entry 26, 28, depending on their application position.

Moreover, it is also possible to dispense with the side walls and for the air supply chamber 36 to be supported for example by a frame structure. In this way, module-like units are formed and a plurality of these may cooperate where necessary.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A method for the surface treatment of articles in a treatment chamber, comprising the steps:

conveying the articles into the treatment chamber, through the treatment chamber along a conveying path, and out of the treatment chamber, during which in any position on the conveying path the articles each determine a direction of conveying that is tangential to the conveying path;

providing at least one multiple-axis application robot which includes an application means and which travels along a robot movement path, wherein the at least one application robot selectively travels with a movement component parallel to the direction of conveying the article or a movement component perpendicular to the direction of the conveying article, wherein the selective movement component of the at least one application robot relative to the conveying direction is determined by a selection of one of multiple conveying paths for an article when entering the treatment chamber, and the selection of which of the multiple conveying paths for the article when entering the treatment chamber is determined based upon an orientation of the article.

2. The method according to claim 1, wherein the at least one application robot travels on a guide rail which determines the path of movement of the robot and is arranged at a height above the articles to be treated that are being conveyed through the treatment chamber.

3. The method according to claim 1, wherein workpiece holders, which hold the articles to be treated, travel on a conveying rail system.

4. The method according to claim 1, wherein different conveying paths for the articles can be determined.

5. The method according to claim 1, wherein the at least one application robot travels on a rectilinear robot movement path.

6. The method according to claim 1, wherein the at least one application robot travels on a robot movement path which is curved, at least in certain regions.

* * * * *